United States Patent [19]

Holcombe et al.

[11] Patent Number: 4,542,708

[45] Date of Patent: Sep. 24, 1985

[54] COMPOSITE CABLE FAIRING

[75] Inventors: Robert R. Holcombe, S. Kingstown; Steven G. Parks, Middletown; Patrick M. Brogan, Bristol, all of R.I.

[73] Assignee: Raytheon Company, Lexington, Mass.

[21] Appl. No.: 568,675

[22] Filed: Jan. 6, 1984

[51] Int. Cl.[4] ..... B63B 21/00

[52] U.S. Cl. ..... 114/243; 267/158

[58] Field of Search ..... 114/243; 267/181, 158, 267/164

[56] References Cited

U.S. PATENT DOCUMENTS

| | | | |
|---|---|---|---|
| 3,042,391 | 7/1962 | Glaser | 267/181 |
| 3,241,513 | 3/1966 | Rather | 114/243 |
| 3,467,047 | 9/1969 | Chatten | 114/243 |
| 3,611,976 | 10/1971 | Hale | 114/243 |
| 4,033,279 | 7/1977 | Stiles | 114/243 |
| 4,171,674 | 10/1979 | Hale | 114/243 |
| 4,200,999 | 5/1980 | Latimer | 114/243 |
| 4,469,729 | 9/1984 | Watanabe | 428/36 |

FOREIGN PATENT DOCUMENTS

| | | | |
|---|---|---|---|
| 1465630 | 12/1966 | France | 114/243 |
| 2091189 | 7/1982 | United Kingdom | 114/243 |

*Primary Examiner*—Trygve M. Blix
*Assistant Examiner*—C. T. Bartz
*Attorney, Agent, or Firm*—Martin M. Santa; Joseph D. Pannone

[57] ABSTRACT

A fairing segment for a cable is of composite construction which combines an elastomeric fairing body with a flexible spring-steel clip in the fairing nose. The elastomeric body allows the fairing nose to conform to the cable catenary in the flow stream, presents a smooth leading edge of the flow, and reduces drag. The clip is flexible in the direction of the plane of the fairing to conform to bending of the cable over sheaves or in the water. The spring steel clip allows the fairing to freely rotate about the cable and to align with the flow stream by maintaining low interfacial friction between the cable and the fairing. The clip also minimizes or prevents cold flow of the elastomeric nose portion of the fairing segment into the interstices of the cable armor. The tail portion of the elastomeric body is stiffened to prevent cupping or bending which would cause kiting of the cable.

13 Claims, 9 Drawing Figures

COMPOSITE CABLE FAIRING

BACKGROUND OF THE INVENTION

This invention relates to a cable fairing and more particularly to a sectioned fairing. Underwater marine systems, which use a cable either as a tether or for towing, benefit from the utilization of cable fairings. Cable fairings are streamlined shapes which attach to underwater cable to reduce fluid drag force and eliminate cable strumming. They allow towed systems to attain significantly deeper depths with a particular length of cable and towing speed. They are a virtual necessity for any high-speed towing applications.

The general design criteria for cable fairings which minimize fluid drag forces are well established: streamlined shape, smooth surface, and a minimum number of surface discontinuities, such as gaps or slots. Practical applications for cable fairing impose additional design requirements. These include: durability, stability during tow, and resistance to the production of lateral forces or kiting. Existing fairing designs meet only some of the above criteria. Designs which are durable and low kiting tend to have high drag and poor performance. Low drag designs have been particularly susceptible to kiting.

Fairing durability and stability result from proper selection of materials and proper geometry. These requirements, by themselves, have been successfully met in numerous existing designs.

Kiting has remained a persistent problem, however, particularly in fairings which have been designed for low drag. This has caused tradeoffs in prior-art fairing designs to provide durability and free motion over cable sheaves. Cable kiting is caused by asymmetric fairing shapes, and/or non-alignment of fairings to the local flow, both which produce forces perpendicular to the flow of stream.

Asymmetric fairings act like cambered wings, and are capable of significant moment about the cable axis and concurrently large lift. Asymmetry may result from poor manufacturing tolerances or from cusping of the fairing trailing edge as the fairing reacts to cable bending and strains the tail section. To allow cables to bend freely without deforming the fairings, the fairings divided into segments along the cable axis. Additionally, much attention has been paid of the fairing nose (the region which surrounds or connects to the tow cable). Fairing designs in the U.S. Navy fleet service employ a rugged stamped steel nose which is curved along the cable axis to match the radius of the winch drum. This prior art design used with sheaves having a compliant supporting liner provides adequate clearance to allow cable bending without deforming the fairing segment. However, the curved (scalloped) leading edge and large gaps between fairing sections greatly increase the drag.

An alternate approach has been to manufacture fairing segments with a flexible nose material such as polyurethane which flexes as the cable bends as described in U.S. Pat. No. 3,611,976. The nose is attached to a rigid tail section which maintains the fairing shape. This approach results in a clean nose shape with virtually no gaps between sections, and therefore, little drag. Unfortunately, the flexible nose material cold-flows and creeps into the interstices of the cable armor and creates resistance to the fairing pivoting freely about the cable to the flow direction. This results in a small local attack angle to the fluid which creates large lateral forces and poor performance (kiting).

The pivoting resistance of the prior art flexible nose fairing is caused by high frictional resistance of the nose material against armored tow cable, and an inability to maintain the necessary clearance in the cable hole. Some flexible fairings have been designed to compress at the end of the nose to reduce the size of drag producing gaps between fairing segments. Additionally, the nose material has a tendency to creep between the armored cable strands after long term storage under tension, further increasing pivoting resistance.

It is therefore an object of this invention to provide a fairing segment which is flexible to conform to cable bending while being resistant to creep into the cable armor thereby allowing the fairing to rotate freely about the cable. It is a further object to provide a fairing which is non-kiting and which has low drag. It is further object of this invention that the fairing segment is also durable and stable. It is a further object to provide a fairing segment which is flexible to bend as the cable bends when towing or as it goes over a sheave and thus eliminate stress concentration in the cable at ends of the fairing segment. It is a further object of this invention to provide a fairing segment which may be molded as a unit which includes the cable hole flexible steel liner with the body of the fairing segment. It is a feature of the invention that the fairing segment surface is smooth and without gaps and seams from the nose to the tail. It is a further feature that substantially the entire interior surface of the fairing segment cable hole in the fairing segment is a flexible yet cold-flow resistant surface. It is, therefore, a feature of this invention that the cale hole in the nose of the fairing segment is lined with a flexible spring steel to prevent the nose material from cold flowing into the interstices of the cable armor. It is another feature that a fairing segment can be removed individually for replacement or repair by simple hand tools. It is a further feature of the invention that the leading edge of the nose of a fairing segment is chamfered to minimize longitudinal compression of the nose as the fairing is carried over a cable sheave.

SUMMARY OF THE INVENTION

These and other objects and features are provided by the fairing segment of this invention which is of composite construction which combines an elastomeric fairing body with a flexible spring steel clip in the fairing nose. The elastomeric body allows the fairing nose to conform to the cable catenary in the flow stream to present a smooth leading edge to the flow of water past the fairing thereby reducing drag. The steel nose clip is flexible in the axial direction and helps the fairing segment to resist axial compression forces on the fairing segment caused by the axial component of drag on the fairing. The clip is also flexible in the transverse direction in the plane of the fairing to conform to cable bending over sheaves or in the water. The spring steel clip prevents cold-flow of the elastomer into the voids of the cable strands and allows the fairing to freely rotate about the cable and align with the flow stream by maintaining low interfacial friction between the cable armor strands and the fairing. The tail portion of the elastomeric body is reinforced with a stiffener plate to prevent cupping or bending which would cause kiting of the cable.

BRIEF DESCRIPTION OF THE DRAWINGS

The objects and features of this invention are explained in the following description taken in conjunction with the accompanying drawings, in which.

DESCRIPTION OF THE PREFERRED EMBODIMENT

Figure 1:
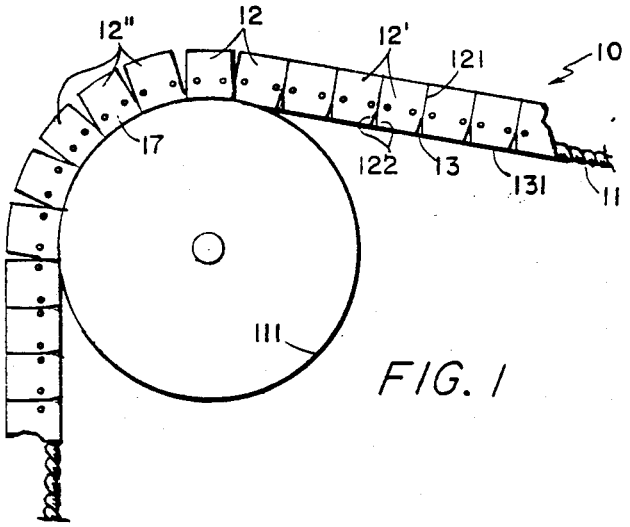
FIG. 1 shows a plan view of a cable within a fairing composed of fairing segments which are linked to each other.

The fairing 10 of this invention in conjunction with an armored tow cable 11 is shown in FIG. 1. The two cable 11 is faired with a plurality of individual composite fairing segments 12 which are stacked against each other along at least a portion of the length of the cable 11. FIG. 1 shows that along an extended relatively straight portion of the cable 11 the fairing segments 12′ have their sides 121 in contact with one another to form a contact area encompassing substantially the entire area of the side 121. The small gap 13 at the leading edge of fairing segments 12′ does not substantially increase the drag; and since there is otherwise no space between the fairing segments 12′, there is little turbulence and drag produced by the fairing segments 12′.

Figure 2:
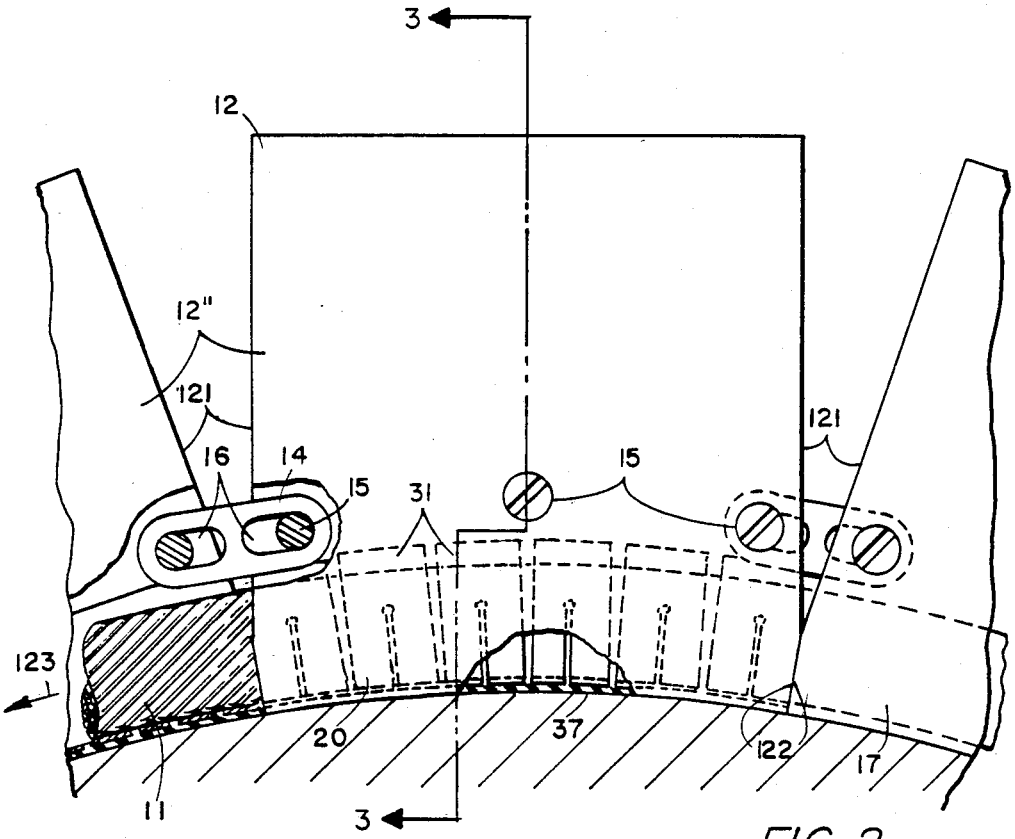
FIG. 2 is a plan view of the faired cable passing over a sheave.

FIG. 1 also shows the fairing segments 12″ as they follow the cable 11 around the sheave 111. It is observed in FIG. 1 that the gap 13 of fairing segments 12″ is closed allowing the fairing segments 12″ to bend around sheave 111 without compressing the nose 17. The included angle of the gap 13 is equal to the angle from the center of sheave 111 subtended by the arc formed by a fairing segment 12″ as it is bent in passing over sheave 111. As seen in the more detailed view of FIG. 2, the chamfered nose 122 of a fairing segment 12 extends to the central axis 123 of cable 11. The angle of chamfered nose 122 is one-half the included angle of gap 13. It is seen that the chamfered noses 122 of adjacent fairing segments 12″ are in contact as the fairing segments 12″ pass over sheave 111.

The individual segments 12 are connected to each other with rigid flat links 14. Each link 14 connects adjacent segments by screws 15 which secure the link to the adjacent fairing segments through elongated holes 16 in each link. Periodically along the length of the cable, typically five to ten feet, the nose 17 of one segment is cut away to accomodate a stacking ring or collar (not shown) which is attached to the cable to distribute the axial load upon the fairing segments produced by the movement of water over the segments, as described in detail in U.S. patent application Ser. No. 537,142, "Cable Fairing Stacking Ring", assigned to the same assignee as this application.

Figure 3:
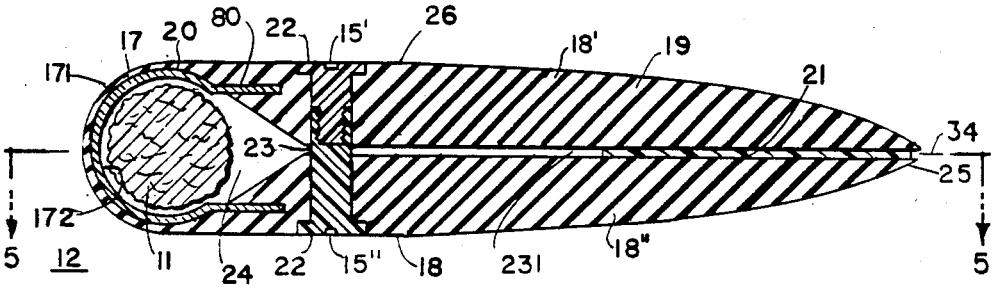
FIG. 3 is a cross-sectional view along section line 3—3 of the fairing segment of FIG. 1.
Figure 5:
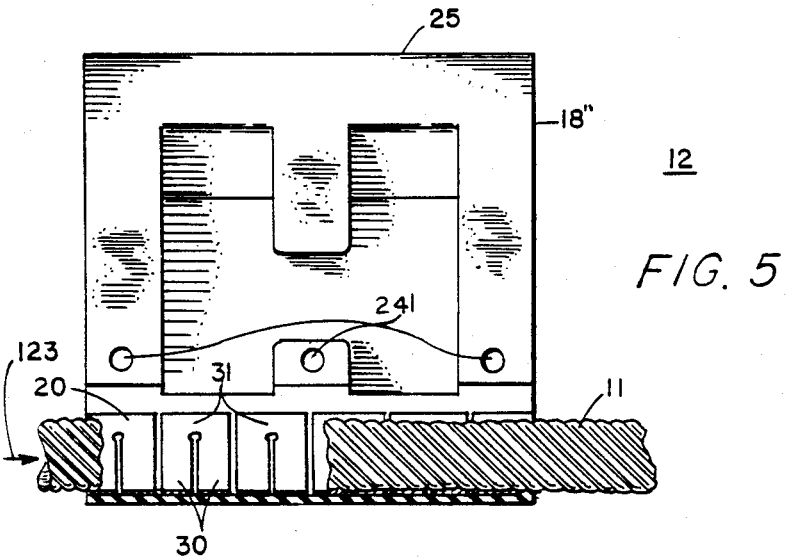
FIG. 5 is a cross-sectional view of the fairing segment and cable along section 5—5 of FIG. 3 showing the spring-steel clip in relation to the sectioned cable.
Figure 4:
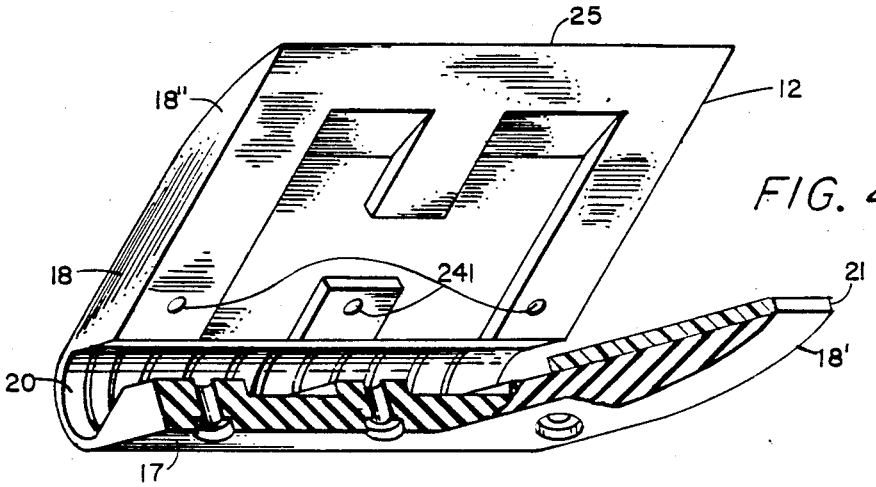
FIG. 4 is an isometric view in partial cross-section of a fairing segment showing the spring-steel clip in the nose of the fairing segment.

A cross-sectional view of the fairing segment 12 through section line 3—3 is shown in FIG. 3. FIG. 4 is a partial cross-section of an isometric view of the fairing segment 12 whereas FIG. 5 is a cross-section along section line 5—5 of FIG. 4 showing the manner in which the steel nose clip 20 encloses the cable 11. The segment 12 has a semicylindrical nose portion 17 smoothly connected to a streamlined afterbody or tail section 18 whose length to thickness ratio is approximately five, the length being measured in the direction transverse to the cable 11 along beam chord line 34. The body profile contour is derived from an existing shape designated "DTMB No. 2", David Taylor Model Basin Report C-433, 1952 which has a center of pressure well back on body 19 toward the tail end 25 for stability of the fairing segment. The profile contour of the tail section 18 is derived from published contours for low drag fairings for tow cables and is not critical to this invention. Each segment 12 consists of a nose 17, an elastomer body 19, a spring steel nose insert 20, a tail stiffener plate 21, and three screw fasteners 22.

The fairing segment body 19 is molded in one piece and consists of the upper half 18′ and lower half 18″ tail sections and a nose section 17 of an elastomeric material 171 integrally vulcanized with the spring-steel nose clip insert 20 as shown in FIG. 3. A typical elastomer is the commercially available elastomer Polysar EDPM356, but the choice of elastomer is not critical. The body 19 is split along the beam cord line 34 from the rearward side 23 of the cable hole 24 to the trailing edge 25 of the fairing 12 to form the upper half 18′ and lower half 18″ tail sections. The nose 17 is reinforced by the steel clip 20 bonded to the elastomer 171 in the molding process. The tail sections 18′, 18″ are fastened together adjacent cable hole 24 with three plastic screws 15 in holes 241 whose heads 22 are flush with the fairing surface 26. The tail sections 18′, 18″ are bonded to a center stiffener plate 21 with a commercially available waterproof adhesive (not shown) whose adhesive strength is chosen to allow easy removal of the fairing segments 12 from the cable 11 by hand, if necessary.

Figure 7:
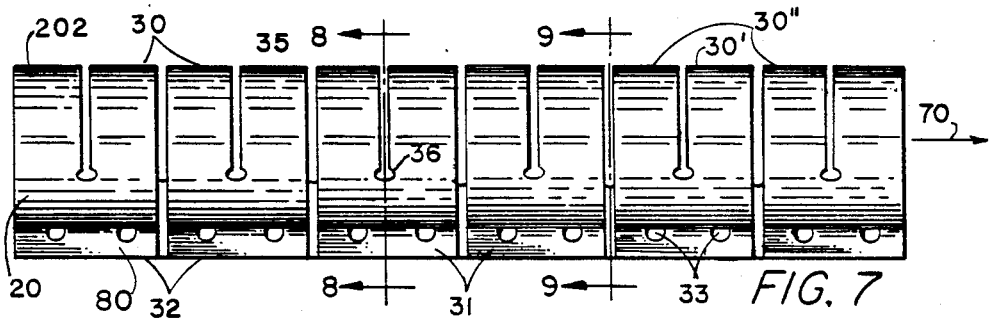
FIG. 7 is a plan view of the forward nose clip.

The fairing segment 12 has been designed to allow easy flexure of the nose portion 17 to adjust to local cable bends and simultaneously to provide a stiff tail section 18. The spring-steel clip 20, which has been molded into the fairing nose 17, has its innermost surface 172 forming the cable-bearing surface of the cable hole 24. The clip 20 is stamped from one-half hard, 0.020 inch thick stainless steel sheet (Nitronic 50 from Armco Steel Co. with a passivated surface finish was found satisfactory) and formed to the partially slotted, cylindrical shape shown in FIGS. 3 and 7. The outermost surface 202 of the clip 20 is roughened and primed to improve adhesion to the elastomer 171 of the fairing nose and body. The interior surface 172 of clip 20 is deburred and finished smooth. Holes 33 are provided to strengthen the bond of clip 20 to the elastomer 171 of the body 19.

Figure 6:
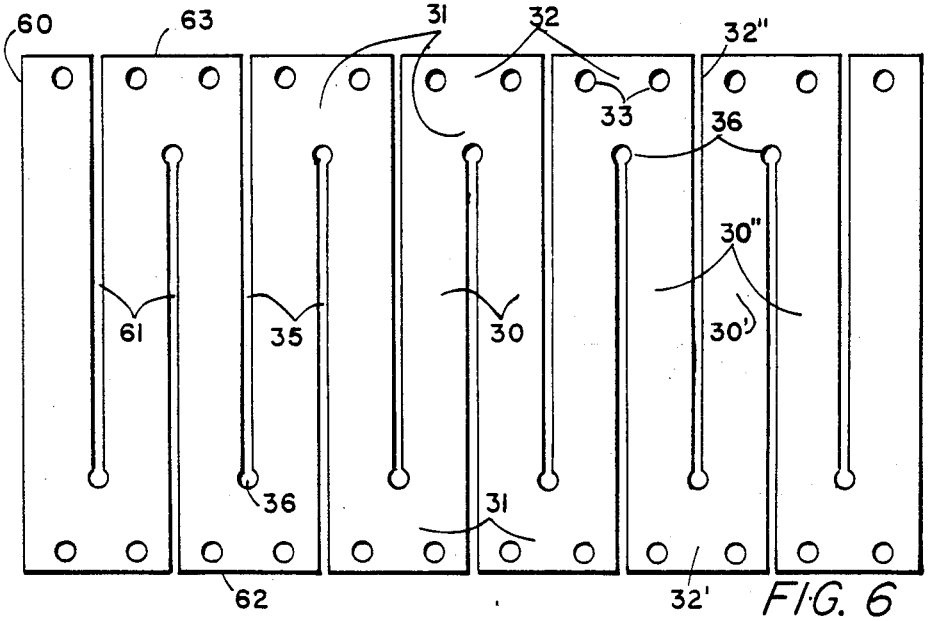
FIG. 6 is a plan view of the stamped spring-steel sheet of the nose clip prior to bending into the cylindrical shape of FIG. 7.
Figure 8:
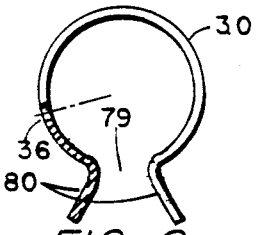
FIGS. 8 and 9 arre sectional views of the nose clip of FIG. 7 taken along section lines 8—8 and 9—9, respectively.
Figure 9:
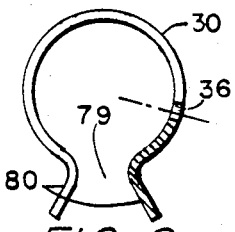

Referring to FIGS. 3, 4 and 5, the spring clip 20 is seen to comprise a plurality of spring clips 30 each connected to an adjacent spring clip by a web 31. FIG. 6 shows the flat steel sheet 60 which is perforated with slits 61, stress relief holes 36, and bonding holes 33 prior to being formed into the partially cylindrical shape of clip 20 with a longitudinal opening 79 shown in FIGS. 8 and 9. FIGS. 8 and 9 show sections taken along section lines 8 and 9 of FIG. 7, respectively. Each clip 30' is connected at its opposite ends 32', 32" to adjacent clips 30", 30" by webs 31 as shown in FIG. 6. It is seen that the slits 61 alternately extend to the edges 62, 63 of sheet 60. Webs 31 are bent out from the generally cylindrical clip 20 to form flaired edges 80 as shown in FIGS. 8 and 9. As a result of slits 61, the nose spring clip 20 is flexible in all directions transverse to its cylindrical axis 70 coincident with cable axis 123. Thus, the fairing nose 17 conforms to cable bends while in the water and while being passed over a sheave 111 for storage on a drum. Each clip 30 has its ends 32 perforated with holes 33 which are filled with the elastomer forming the body 19 to thereby more securely bond the clip 20 to the body 19. The clip 20 is located at the most forward portion of the nose 17 where the greatest force is applied between the fairing 12 and the cable 11 when the fairing is in the water or is wound about a sheave. Each clip 30 is typically approximately one-half inch wide in the axial direction 70 and separated from an adjacent clip by a 16th-inch gap 35 (the width of slit 61) which terminates in a stress relief circle 36 of approximately one-eighth inch diameter.

The flexible fairing nose clip 20 allows the nose of the fairing body to bend elastically as the cable 11 is reaved over sheaves and winch drums and secondarily helps the fairing segment to withstand fairing compressive loads applied longitudinally along the axis of the cable. Clip 20 also provides a low friction surface on the interior of the cable hole 24 of fairing 12 to provide a bearing surface inside the nose 17 which restrains the elastomer 171 from creeping out and extruding between the strands of the cable 11 after prolonged periods of contact against sheaves and winch drums to resist permanent deformation of fairing 12 in normal use. The fairing nose clip 20 performs all of the above functions by combining a unique geometry with careful material selection. The spring steel clip 20 is slotted laterally with slots 61 to allow flexture over sheaves, yet provides a nearly continuous strip of steel at the fairing nose to resist compression deformation of each fairing segment 12. Clip 20 also retains the circular shape of the fairing nose when the fairing 12 is flexed. These features combined with the low friction interior surface 172 contacting the cable 11 allows the fairing segments 12 to pivot freely about the cable and align itself with the local water flow, and therefore minimize any lateral forces which cause kiting. The ability of the spring steel clip 20 to flex with the curvature of the cable allows the fairing body to be molded as a one-piece molding in a configuration which minimizes the width of gaps between fairing segments 12 and provides a leading edge 37 which always conforms to the cable 11.

The tail stiffener plate 21 is composed of a flat piece of fiber reinforced plastic, the commercially available glass filled reinforced epoxy laminate "G10" is suitable. The function of the plate 21 is to provide structural rigidity to the tail section 18 of the fairing 12 to help maintain its shape in turbulent flow and to rigidly connect the thin trailing edges 181 of the two fairing tail halves 18', 18".

The tail halves 18', 18" are fastened together in the region just to the rear of the cable opening 24 by using three plastic fasteners 15. Each fastener consists of two shouldered halves 15', 15" (typically of Delrin material) which when tightened are so dimensioned that there remains a space 231 equal in width to the thickness of the plate 21 between the two tail portions 18', 18". Referring to FIG. 1, the outermost fasteners 15 restrain the connecting links 14 whose thickness is equal to that of the stiffening plate 21. The connecting links 14 are therefore free to move in the space 231 being constrained only by their slots 16. Link 14 may be made of the same material (and thickness) as the stiffener plate 21. The slots 16 in the link 14 accommodate the separation of the fairing segments during bending over sheaves and drums.

Having described a preferred embodiment of the invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A fairing segment for a cable comprising:

a body of an elastomeric material having a cylindrical nose portion and a tail portion of a streamline shape connected to said nose portion;

said cylindrical nose portion having a hole with a hole axis coincident with the axis of said cylinder for said cable;

said nose having its hole lined with a flexible insert;

said insert being constructed of a material having a hardness greater than that of said body; and said insert being bonded to said body.

2. The fairing segment of claim 1 wherein said insert material is spring-steel.

3. The fairing segment of claim 1 wherein said insert comprises a spring-steel cylindrical clip having slots;

each slot extending transversely to the axis of said cylindrical clip to one edge of said cylindrical clip and toward but short of the opposite edge of said cylindrical clip;

said cylindrical clip form having a longitudinal opening along the wall of said cylindrical clip with flared edges extending outwardly from the edges of said opening;

said flares each having a longitudinal edge; and alternate said slots extending to the longitudinal edge of one flared edge and terminating before reaching the longitudinal edge of the other flared edge.

4. The fairing segment of claim 3 wherein:

said flared edges have holes through which the material of the body extends to mechanically secure the spring-steel cylinder clip to said body material.

5. The fairing segment of claim 1 wherein:

said tail portion comprises first and second tail portions which are symmetrical with respect to a plane through said cylinder axis;

said nose and said insert being sufficiently flexible to allow said first and second tail portions to be separated from each other and to pass over said cable to allow said cable to be positioned within the hole in said nose; and means for fastening said upper and lower half tail portions to form said tail portion.

6. The fairing segment of claim 5 comprising in addition:

a stiffening plate between and secured to said first and second tail portions to prevent substantial motion of said portions.

7. The fairing segment of claim 5 wherein:

said fastening means comprises a releasable screw means whereby said fairing first and second tail portions may be separated to remove said fairing from said cable by releasing said screw means.

8. The fairing segment of claim 5 wherein fastening means comprises: 'mating screws;

said first and second tail portions having opposed holes through each portion;

each of said mating screws secured to each other through said opposed holes;

said holes being countersunk at the outermost surface of said tail portions;

said screws having heads which are secured in said countersunk holes to provide a surface which is flush with the outermost surface of said half tail portions; and a stiffener plate attached between said first and second tail portions.

9. A fairing segment for a cable comprising:

a body of a flexible material having a streamline shape;

said streamlined body comprising a nose portion and an integral tail portion;

said body having a length transverse to said streamline;

said nose portion having a hole extending longitudinally along the length of said body for said cable;

an insert in said hole bonded to said nose and between the material of said nose and said cable; and said insert being of a harder material than said body and flexible to bend to conform to bending of the cable.

10. The fairing segment of claim 9 wherein said insert material is spring steel.

11. The fairing segment of claim 9 wherein said insert comprises a spring-steel cylinder having slots;

each slot extending transversely to the edge of said cylinder toward and short of the opposite edge of said cylinder;

said cylinder form having a longitudinal opening along the wall of said cylinder with flared edges extending outwardly from the edges of said opening;

said flares each having a longitudinal edge; and alternate said slots extending to the longitudinal edge of one flared edge and terminating before reaching the longitudinal edge of the other flared edge.

12. The fairing segment of claim 11 wherein:

said flared edges have holes through which the material of the body extends.

13. The fairing segment of claim 9 wherein:

said tail portion comprises first and second tail portions which are symmetrical with respect to a plane through said cylinder axis;

said nose and said insert being sufficiently flexible to allow said first and second tail portions to pass around said cable and to allow said cable to be positioned within the hole in said nose;

means for fastening said first and second tail portions to form said tail portion; and means for stiffening said tail portion to prevent bending of the tail portion.

* * * * *